United States Patent [19]

Jung

[11] Patent Number: 4,946,150

[45] Date of Patent: Aug. 7, 1990

[54] METHOD AND FABRIC LAYING MACHINE FOR EXACT POSITIONING OF A LEADING EDGE OF A FABRIC WEB

[75] Inventor: Rolf Jung, Waiblingen, Fed. Rep. of Germany

[73] Assignee: Krauss u. Reichert GmbH & Co., Stuttgart, Fed. Rep. of Germany

[21] Appl. No.: 286,423

[22] Filed: Dec. 19, 1988

[30] Foreign Application Priority Data

Dec. 24, 1987 [DE] Fed. Rep. of Germany ..... 3744036

[51] Int. Cl.[5] ..... B65H 29/46

[52] U.S. Cl. ..... 270/31; 493/937

[58] Field of Search ..... 270/30, 31, 52.5; 493/937

[56] References Cited

U.S. PATENT DOCUMENTS

| | | | |
|---|---|---|---|
| 4,381,859 | 5/1983 | Jung | 270/31 |
| 4,392,646 | 7/1983 | Costigan | 270/31 |
| 4,589,644 | 5/1986 | Gratsch | 270/31 |

FOREIGN PATENT DOCUMENTS

| | | | |
|---|---|---|---|
| 0006009 | 5/1979 | European Pat. Off. . | |
| 0109101 | 10/1983 | European Pat. Off. . | |
| 0200604 | 4/1986 | European Pat. Off. . | |
| 60-52467 | 3/1985 | Japan | 270/52.5 |
| 62-167177 | 7/1987 | Japan | 270/52.5 |
| 2096197 | 3/1982 | United Kingdom . | |

*Primary Examiner*—Edward K. Look
*Assistant Examiner*—Therese M. Newholm
*Attorney, Agent, or Firm*—Kramer, Brufsky & Cifelli

[57] ABSTRACT

In order to achieve exact positioning of a leading edge of a fabric web in a fabric web guide of a fabric spreading machine, it is suggested for a method and apparatus that the fabric web is moved forward with its leading edge in the direction of spreading up to the starting line, the leading edge is then detected and the fabric web slowed down and stopped, that after stopping it is determined whether or not the leading edge coincides with the starting line, and that when the leading edge does not coincide with the starting line the fabric web is withdrawn contrary to the direction of spreading for a predetermined distance and then moved forward again in the direction of spreading up to the starting line.

13 Claims, 2 Drawing Sheets

METHOD AND FABRIC LAYING MACHINE FOR EXACT POSITIONING OF A LEADING EDGE OF A FABRIC WEB

The invention relates to a method of exactly positioning a leading edge of a fabric web in a fabric web guide of a fabric spreading machine at a starting line.

In addition, the invention relates to a fabric spreading machine, in particular for carrying out the above-mentioned method, which comprises a fabric web advancing means and a positioning means for laying a leading edge of a fabric web at a starting line, including at least one fabric web sensor.

In fabric spreading machines it is necessary, for accurate spreading of the fabric, for the leading edge of the fabric web to be positioned exactly at the respective starting line for spreading to obtain a precisely measured stack of layers. In previously known methods and devices, the leading edge of the fabric web is positioned at the starting line in that a fabric web sensor which is arranged far upstream of the starting line detects the leading edge of the fabric web and generates a signal. Following this signal, the fabric web is unwound in the direction of spreading for a predetermined period of time in response to the fabric advancing speed. This time is determined such that the length of the unwound portion of fabric web corresponds to the distance between the starting line and the fabric web sensor.

However, this procedure does have, on the one hand, the disadvantage that it does not enable the fabric web to be positioned exactly at the starting line since the position of the leading edge is not determined right at the starting line and, on the other hand, the disadvantage that it is not possible to determine, with this procedure, whether the leading edge has actually reached the starting line or is located in front of or behind the starting line due to a machine error, for example faulty slowing down of the fabric advancing means.

The object underlying the invention is therefore to improve a method and device of the type in question such that an exact positioning of the leading edge of the fabric web at the starting line is possible and faulty positionings can still be detected.

This object is accomplished in accordance with the invention, in a method of the type described at the outset, by moving the fabric web forward with its leading edge in the direction of spreading up to the starting line, then detecting the leading edge and slowing down and stopping the fabric web, by determining, once the fabric web is stopped, whether or not the leading edge coincides with the starting line and, when the leading edge does not coincide with the starting line, by withdrawing the fabric web contrary to the direction of spreading for a predetermined distance and then moving it forward again in the direction of spreading up to the starting line.

The inventive method therefore has the advantage that the position of the leading edge is detected right at the starting line and it can then be determined whether or not the leading edge is positioned exactly at the starting line. In addition, this method also takes into account the fact that guidance of the fabric web in the fabric spreading machine is always subject to play and that the fabric web, a portion of which normally lies freely in the fabric web guide, creates further sources for inaccuracies, for example due to the formation of folds or the like. For this reason, it is not possible to correct the position of the fabric web by moving it slightly forwards or backwards when the leading edge is not positioned exactly on the starting line as this would lead to additional errors and faulty positionings. The advantage of the inventive method is therefore to be seen in the fact that it rules out these additional sources of error due to the fact that the fabric web is wound back a predetermined distance and then moved forward again in the direction of spreading. This means that the fabric web is moved forward towards the starting line from the same direction and under the same conditions each time it is positioned at the starting line and so any play or other inaccuracies will have no effect.

To prevent control errors or other inaccuracies occurring when the fabric web is wound back by the predetermined distance, it is advantageous for it to be determined whether or not the leading edge has been withdrawn by this predetermined distance. It is then possible for a control means of the fabric spreading machine to detect that the fabric web has been wound back correspondingly and so, subsequently, the fabric web can be moved forward again up to the starting line.

In order to be able to move the fabric web to the starting line as accurately as possible, the fabric web is moved forward at full speed until the leading edge has reached a predetermined distance from the starting line and subsequently the leading edge is moved forward at crawling speed up to the starting line. This is particularly simple when the predetermined distance by which the fabric web is withdrawn is identical to the predetermined distance from which the leading edge is moved forward at crawling speed.

The inventive object is also accomplished in accordance with the invention, in a fabric spreading machine of the type described at the outset, in that at least one fabric web sensor is arranged both upstream and downstream of the starting line in the direction of spreading so that when the leading edge coincides with the starting line the fabric web sensor arranged upstream of the starting line is covered and the fabric web sensor arranged downstream of the starting line is not. A control means associated with the positioning means is therefore in a position to decide whether or not the leading edge of the fabric web is positioned exactly at the starting line and can then, it necessary, cause the fabric web to be wound back and the leading edge of the fabric web to be moved forward again up to the starting line.

In conjunction with the inventive solution it may be appropriate for a plurality of fabric web sensors to be arranged both upstream and downstream of the starting line at various distances therefrom. The positioning means can then, in addition, detect any faulty positioning of the leading edge of the fabric web at the starting line and decide whether or not it is necessary to wind back the fabric web and move the leading edge forward again up to the starting line.

In a further embodiment, the fabric web sensors are appropriately located immediately adjacent the starting line since this arrangement represents the most accurate possibility of detecting the position of the leading edge of the fabric web.

Particularly when it is to be detected, in addition, whether the fabric web has been wound back to a sufficient extent with its leading edge, an additional fabric web sensor is provided at a distance upstream of the starting line for detecting the predetermined distance by which the fabric web is to be wound back. With this sensor, the control means of the positioning means is in a position to determine that the fabric web has been wound back a sufficient distance to compensate for all inaccuracies occurring during advancing of the fabric web. Moreover, with this sensor it is possible to switch over again to moving the fabric web forward at crawling speed up to the starting line.

In a particularly simple embodiment of the fabric web sensors, these are designed as photoelectric cells, preferably photoelectric cells having an integrated source of radiation which then determine by reflection whether or not their active surfaces are covered by a fabric web.

Additional features and advantages of the invention are the subject matter of the following description as well as the drawings of a number of embodiments. In the drawings, FIG. 1 is a side view of an inventive fabric spreading machine with the spreading unit cut open;

Figure 1:
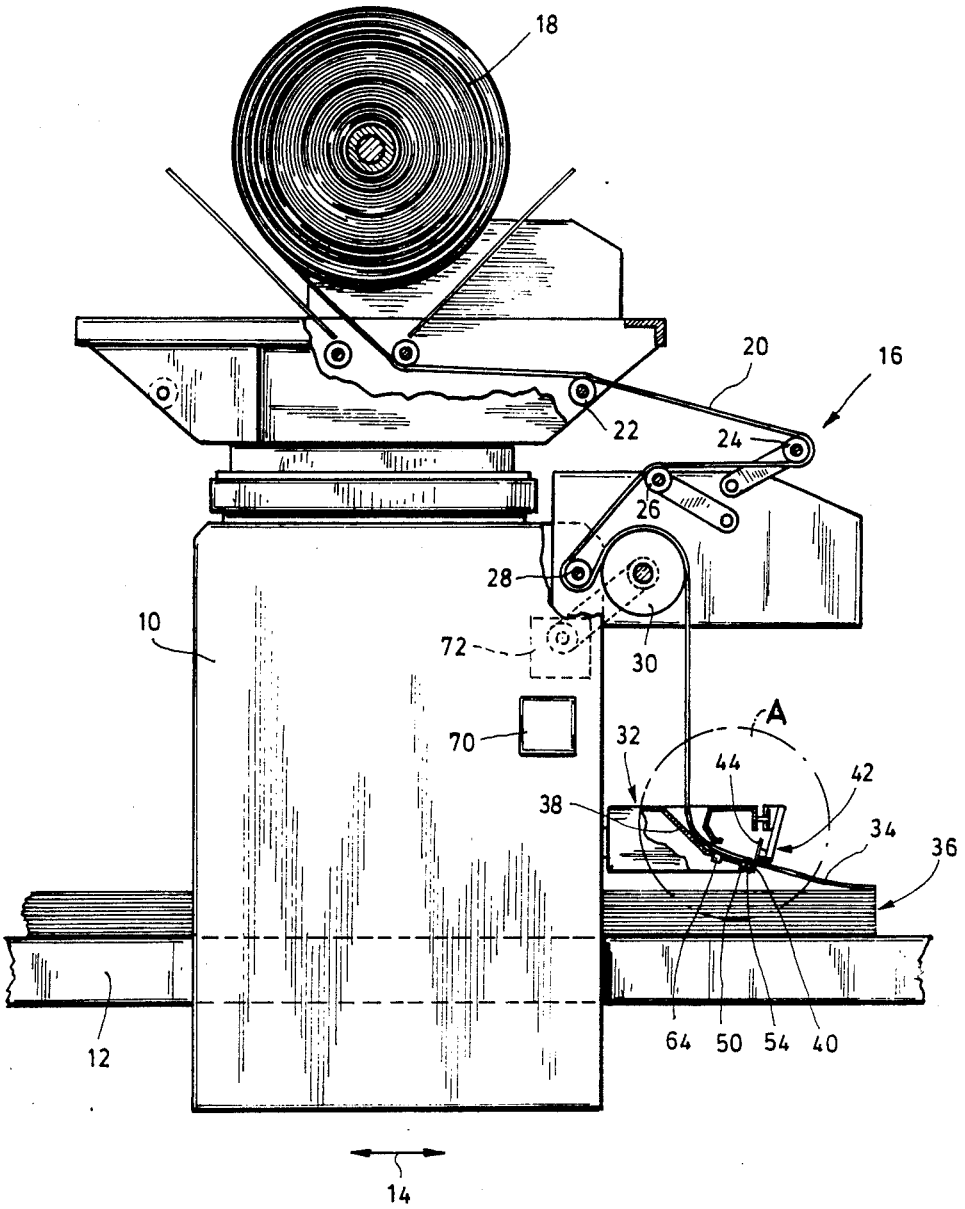

An embodiment of an inventive fabric spreading machine, illustrated in FIG. 1, shows a spreading carriage designated as a whole as 10 and mounted for reciprocating movement along a spreading table 12 in the direction of arrow 14. This spreading carriage 10 has a fabric web guide designated as a whole as 16. This withdraws a fabric web 20 from a fabric roll 18, guides the web via deflecting rollers 22, 24, 26 and 28 to an advancing roller 30, from there the fabric web is fed to a spreading unit 32 and after passing therethrough is laid as a fabric layer 34 on the spreading table 12 in the form of a stack of layers 36.

In the spreading unit 32 the fabric web 20 slides along a spreading blade 38 and is laid out as fabric layer 34 proceeding from a front laying-out edge 40 of the spreading blade 38.

A cutting means designated as a whole as 42 is also integrated in the spreading unit 32. This cutting means comprises a preferably rotary knife 44 and is therefore capable of cutting off the fabric web 20 by running along the laying-out edge 40.

The inventive fabric spreading machine operates such that when a fabric web 20 is rethreaded it is first pushed forward beyond the laying-out edge 40 and cut straight across along the laying-out edge 40 by the knife 44 of the cutting means 42 so that the fabric web has a straight leading edge 46 as required for an exact spreading.

However, during spreading with the fabric spreading machine the fabric web 20 may not only be laid out in one direction but, in particular for so-called "spreading in pairs", has to be turned and laid out in this state, i.e. turned through 180°. In this case, it is necessary to position the leading edge 46 of the fabric web 20 exactly at the laying-out edge following unthreading of the fabric web 20 from the fabric web guide 16 and renewed threading, while avoiding, if possible, any renewed cutting of the fabric web 20 to obtain a defined position of the leading edge.

For this reason, the invention includes a positioning means which comprises a photosensor 50 arranged in front of the laying-out edge 40 in the direction of spreading 48 of the fabric web 20 as well as a photosensor 54 arranged behind the laying-out edge 40 in the direction of spreading 48. The active surface 52 of the photosensor 50 is preferably located immediately adjacent the laying-out edge 40 and the active surface 56 of the photosensor 54 is also preferably located immediately adjacent the laying-out edge 40.

Figure 2:
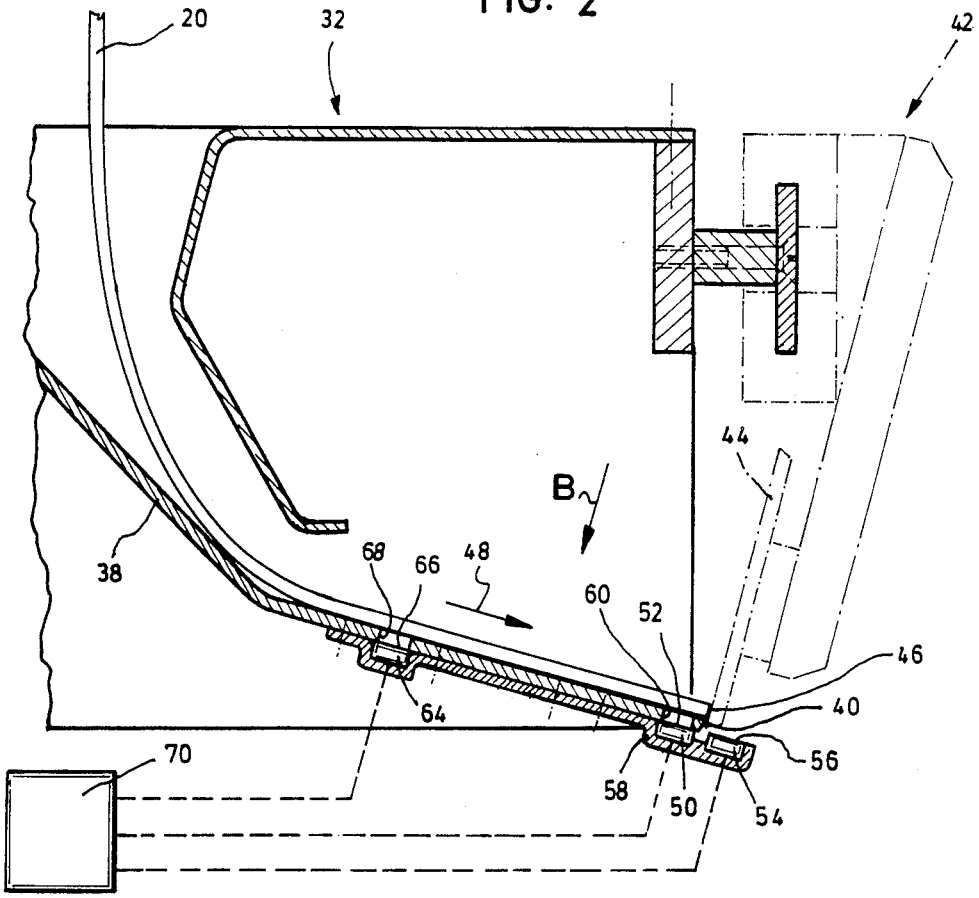
FIG. 2 is an enlarged illustration of section A in FIG. 1.
Figure 3:
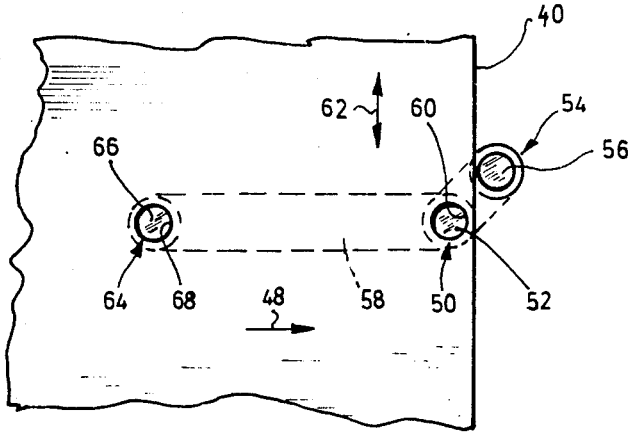
FIG. 3 is a plan view in the direction of arrow B in FIG. 2.

As shown in FIG. 2, the photosensors 50 and 54 are preferably mounted on a bracket 58 beneath the spreading blade 38. The photosensor 54 located downstream of the laying-out edge 40 is arranged so as to protrude beyond the leading edge 46 in the direction of spreading 48 while the photosensor 50 located upstream of the laying-out edge 40 is arranged such that its active surface 52 is congruent with a bore 60 which penetrates the spreading blade 38 and is contiguous to the laying-out edge 40. This means that the photosensor 50 detects the fabric web 20 through the bore 60. The two photosensors 50 and 54 are preferably arranged so as to be offset relative to one another in a direction 62 transverse to the direction of spreading 48 so that their active surfaces 52 and 56, respectively, are located as close as possible to the laying-out edge 40.

In addition, a further photosensor 64 is provided on the underside of the spreading blade 38 at a distance from the laying-out edge 40. The active surface 66 of this photosensor is congruent with a bore 68 and is able, through this bore, to detect the fabric web 20 lying on the spreading blade 38 at the predetermined distance upstream of the laying-out edge 40.

All the photosensors 50, 54 and 64 communicate with a control means 70 which controls a drive means 72 for the advancing roller 30.

When the fabric web 20 is again threaded into the fabric web guide 16 with a leading edge 46 which is already cut in a straight line, the advancing roller 30 is driven such that the fabric web 20 slides along the spreading blade 38 with its leading edge 46. When the leading edge 46 passes the photosensor 64 the latter sends a corresponding signal to the control means 70. The control means 70 then slows down the speed of the advancing roller and the leading edge 46 moves in the direction of spreading 48 towards the laying-out edge at a reduced speed. As soon as the leading edge 46 covers the active surface 52 of the photosensor 50, this generates a signal to halt, on the basis of which the drive means 72 is braked and so the fabric web 20 is no longer transported further in the direction of spreading 48 by the advancing roller 30. If it is possible to carry out the braking procedure with sufficient accuracy, the active surface 66 of the photosensor 64 as well as the active surface 52 of the photosensor 50 are covered and the control means 70 determines that the leading edge 46 is now positioned exactly at the laying-out edge 40.

It may, however, occur that the drive means 72 is not braked in time or due to other faults it is not determined in time that the leading edge 46 has covered the active surface 52 of the photosensor 50. In this case, the fabric web moves beyond the laying-out edge 40 and so the fabric web 20 then also covers the active surface 56 of the photosensor 54. When this is recognized by the control means it gives the drive means 72 of the advancing roller 30 the command to wind the fabric web 20 back contrary to the direction of spreading 48 and not only just so far that the leading edge 46 coincides with the laying-out edge 40 since, due to the tolerances in the fabric web guide 16 as well as the difficulty of exactly positioning the loosely falling fabric web 20, this would not represent a positioning of the leading edge 46 which is carried out with the necessary accuracy. Rather, the fabric web 20 is wound back until the photosensor 63 is no longer covered by the fabric web 20 and this is signalled to the control means 70. The control means 70 then switches over the drive means 72 of the advancing roller 30 again so that the fabric web 20 again moves, with its leading edge 46, in the direction of spreading 48 along the spreading blade 38. It first of all covers the photosensor 64 and is then moved forward at reduced speed until the active surface 52 of the photosensor 50 is covered but the active surface 56 of the photosensor 54 is not. If this is the case, the control means 70 will recognize that the leading edge 46 of the fabric web 20 is now exactly positioned.

The present disclosure relates to the subject matter disclosed in German application No. P 37 44 036.5 of Dec. 24, 1987, the entire specification of which is incorporated herein by reference.

What is claimed is:

1. A method of exactly positioning a transverse leading edge of a fabric web extending transversely to a longitudinal spreading direction of said fabric web in a fabric web guide of a fabric spreading machine at a starting line, comprising the following steps:

(a) the fabric web is moved forward with its leading edge in the direction of spreading up to the starting line, (b) the leading edge is then detected and the fabric web slowed down and stopped, (c) after stopping it is determined whether or not the leading edge coincides with the starting line, (d) when the leading edge coincides with the starting line the positioning is finished, (e) when the leading edge does not coincide with the starting line the fabric web is withdrawn contrary to the direction of spreading until the leading edge is located at a predetermined distance behind the starting line and then the fabric web is moved forward again in the direction of spreading up to the starting line, whereupon at least steps (b) and (c) are performed again.

2. A method of exactly positioning a leading edge of a fabric web in a fabric web guide of a fabric spreading machine at a starting line, comprising the following steps:

(a) the fabric web is moved forward with its leading edge in the direction of spreading up to the starting line, (b) the leading edge is then detected and the fabric web slowed down and stopped, (c) after stopping it is determined whether or not the leading edge coincides with the starting line, (d) when the leading edge does not coincide with the starting line the fabric web is withdrawn contrary to the direction of spreading for a predetermined distance wherein it is determined whether or not the leading edge has been withdrawn by the predetermined distance and then the fabric web is moved forward again in the direction of spreading up to the starting line.

3. Method as defined in claim 2, characterized in that the fabric web is moved forward at full speed until the leading edge has reached a predetermined distance from the starting line and subsequently the leading edge is moved forward at crawling speed up to the starting line.

4. Fabric spreading machine, in particular for carrying out the method as defined in claim 2, comprising a fabric advancing means and a positioning means for laying a leading edge of a fabric web at a starting line, including at least one fabric web sensor, characterized in that at least one fabric web sensor (50, 54) is arranged both upstream and downstream of the starting line (40) in the direction of spreading so that when the leading edge (46) coincides with the starting line (40) the fabric web sensor (50) arranged upstream of the starting line is covered and the fabric web sensor (54) arranged downstream of the starting line (40) is not.

5. A method of exactly positioning a leading edge of a fabric web in a fabric web guide of a fabric spreading machine at a starting line, comprising the following steps:

(a) the fabric web is moved forward with its leading edge in the direction of spreading up to the starting line, (b) the leading edge is then detected and the fabric web slowed down and stopped, (c) after stopping it is determined whether or not the leading edge coincides with the starting line, (d) when the leading edge does not coincide with the starting line the fabric web is withdrawn contrary to the direction of spreading for a predetermined distance wherein and then the fabric web is moved forward again in the direction of spreading up to the starting line, further characterized in that the fabric web is moved forward at full speed until the leading edge has reached the predetermined distance from the startling line and subsequently the leading edge is moved forward at crawling speed up to the starting line.

6. Fabric spreading machine, in particular for carrying out the method as defined in claim 5, comprising a fabric advancing means and a positioning means for laying a leading edge of a fabric web at a starting line, including at least one fabric web sensor, characterized in that at least one fabric web sensor (50, 54) is arranged both upstream and downstream of the starting line (40) in the direction of spreading so that when the leading edge (46) coincides with the starting line (40) the fabric web sensor (50) arranged upstream of the starting line is covered and the fabric web sensor (54) arranged downstream of the starting line (40) is not.

7. Fabric spreading machine, comprising a means for advancing a fabric web in a direction of spreading up to a starting line, a positioning means for detecting a leading edge of the fabric web at the starting line and stopping said means for advancing if said leading edge coincides with said starting line, including at least one fabric web sensor arranged both upstream and downstream of the starting line in the direction of spreading so that when the leading edge coincides with the starting line the fabric web sensor arranged upstream of the starting line is covered and the fabric web sensor arranged downstream of the startling line is not, a means for withdrawing said fabric web contrary to the direction of spreading until said leading edge is positioned at a predetermined distance behind the starting line if the positioning means discovers non-coincidence with said starting line, and a means for restarting said means for advancing after positioning said leading edge at said predetermined distance.

8. Fabric spreading machine as defined in claim 7, characterized in that the fabric web sensors are located immediately adjacent the starting line.

9. Fabric spreading machine as defined in claim 3, characterized in that an additional fabric web sensor (64) is arranged at a distance upstream of the starting line (40).

10. Fabric spreading machine as defined in claim 8, characterized in that the fabric web sensors (50, 54, 64) are designed as photoelectric cells.

11. Fabric spreading machine as defined in claim 7, characterized in that an additional fabric web sensor is arranged at a distance upstream of the starting line.

12. Fabric spreading machine as defined in claim 11, characterized in that the fabric web sensors (50, 54, 64) are designed as photoelectric cells.

13. Fabric spreading machine as defined in claim 7, characterized in that the fabric web sensors are designed as photoelectric cells.

* * * * *

UNITED STATES PATENT AND TRADEMARK OFFICE

CERTIFICATE OF CORRECTION

PATENT NO. : 4,946,150

DATED : August 7, 1990

INVENTOR(S) : Rolf Jung

It is certified that error appears in the above-identified patent and that said Letters Patent is hereby corrected as shown below:

Column 2, line 45, change "it" to -- if --.

Signed and Sealed this

Eighteenth Day of February, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,946,150

DATED : August 7, 1990

INVENTOR(S) : Rolf Jung

It is certified that error appears in the above-identified patent and that said Letters Patent is hereby corrected as shown below:

On the title page, Item [73] Assignee: should read --Krauss u. Reichert GmbH + Co. KG Spezialmaschinenfabrik--.

Column 2, line 45, change "it" to --if--.

Delete claims 3-13, inclusive, in their entirety and insert in lieu thereof:

-- 3. A method of exactly positioning a leading edge of a fabric web in a fabric web guide of a fabric spreading machine at a starting line, comprising the following steps:

a) the fabric web is moved forward with its leading edge in the direction of spreading up to the starting line, b) the leading edge is then detected and the fabric web slowed down and stopped, c) after stopping it is determined whether or not the leading edge coincides with the starting line, d) when the leading edge does not coincide with the starting line the fabric web is withdrawn contrary to the direction of spreading for a predetermined distance wherein and then the fabric web is moved forward again in the direction of spreading up to the starting line, further characterized in that the fabric web is moved forward at full speed until the leading edge has reached the predetermined distance from the starting line and subsequently the leading edge is moved forward at crawling speed up to the starting line.

4. Fabric spreading machine, comprising a means for advancing said fabric web in a direction of spreading up to a starting line, a positioning means for detecting a leading It is certified that error appears in the above-identified patent and that said Letters Patent is hereby corrected as shown below:

edge of a fabric web at a starting line and stopping said means for advancing if said leading edge coincides with said starting line, including at least one fabric web sensor arranged both upstream and downstream of the starting line in the direction of spreading so that when the leading edge coincides with the starting line the fabric web sensor arranged upstream of the starting line is covered and the fabric web sensor arranged downstream of the starting line is not, a means for withdrawing said fabric web contrary to the direction of spreading until said leading edge is positioned at a predetermined distance behind the starting line if the positioning means discovers non-coincidence with said starting line, and a means for restarting said means for advancing after positioning said leading edge at said predetermined distance.

5. Fabric spreading machine as defined in claim 4, characterized in that the fabric web sensors are located immediately adjacent the starting line.

6. Fabric spreading machine as defined in claim 4, characterized in that an additional fabric web sensor is arranged at a distance upstream of the starting line.

7. Fabric spreading machine as defined in claim 4, characterized in that the fabric web sensors are designed as photoelectric cells.

8. Method as defined in claim 2, characterized in that the fabric web is moved forward at full speed until the leading edge has reached a predetermined distance from the starting It is certified that error appears in the above-identified patent and that said Letters Patent is hereby corrected as shown below:

line and subsequently the leading edge is moved forward at crawling speed up to the starting line.

9. Fabric spreading machine, in particular for carrying out the method as defined in claim 2, comprising a fabric advancing means and a positioning means for laying a leading edge of a fabric web at a starting line, including at least one fabric web sensor, characterized in that at least one fabric web sensor (50, 54) is arranged both upstream and downstream of the starting line (40) in the direction of spreading so that when the leading edge (46) coincides with the starting line (40) the fabric web sensor (50) arranged upstream of the starting line is covered and the fabric web sensor (54) arranged downstream of the starting line (40) is not.

10. Fabric spreading machine, in particular for carrying out the method as defined in claim 3, comprising a fabric advancing means and a positioning means for laying a leading edge of a fabric web at a starting line, including at least one fabric web sensor, characterized in that at least one fabric web sensor (50, 54) is arranged both upstream and downstream of the starting line (40) in the direction of spreading so that when the leading edge (46) coincides with the starting line (40) the fabric web sensor (50) arranged upstream of the starting line is covered and the fabric web sensor (54) arranged downstream of the starting line (40) is not.

11. Fabric spreading machine as defined in claim 5, characterized in that an additional fabric web sensor (64) is arranged at a distance upstream of the starting line (40).

UNITED STATES PATENT AND TRADEMARK OFFICE

CERTIFICATE OF CORRECTION

PATENT NO. : 4,946,150

DATED : August 7, 1990

INVENTOR(S) : Rolf Jung

It is certified that error appears in the above-identified patent and that said Letters Patent is hereby corrected as shown below:

12. Fabric spreading machine as defined in claim 5, characterized in that the fabric web sensors (50, 54, 64) are designed as photoelectric cells.

13. Fabric spreading machine as defined in claim 6, characterized in that the fabric web sensors (50, 54, 64) are designed as photoelectric cells. --

Signed and Sealed this

Sixth Day of April, 1993

*Attest:*

STEPHEN G. KUNIN

*Attesting Officer*

*Acting Commissioner of Patents and Trademarks*